United States Patent [19]

Raska

[11] Patent Number: 4,875,781

[45] Date of Patent: Oct. 24, 1989

[54] PAINT MIXING PAINT CONTAINER

[76] Inventor: Jack C. Raska, 29249 32 Mile Rd., Richmond, Mich. 48062

[21] Appl. No.: 196,054

[22] Filed: May 19, 1988

[51] Int. Cl.[4] ..... B01F 9/10

[52] U.S. Cl. ..... 366/130; 366/226; 366/228; 366/307

[58] Field of Search ..... 366/605, 129, 130, 210, 366/211, 237, 213, 601, 302, 225, 226, 228, 307; 220/85 SP, 22

[56] References Cited

U.S. PATENT DOCUMENTS

| | | | |
|---|---|---|---|
| D. 23,086 | 1/1974 | Meisner . | |
| D. 28,095 | 12/1897 | Mills . | |
| D. 28,326 | 3/1898 | Joy . | |
| D. 245,450 | 8/1977 | Donion . | |
| 482,082 | 9/1892 | Deming . | |
| 820,631 | 5/1906 | Eckart | 366/605 |
| 1,032,663 | 7/1912 | Fay | 366/307 |
| 1,989,019 | 1/1935 | O'Keeffe | 366/130 |
| 2,516,655 | 7/1950 | Smith | 366/237 |
| 3,224,742 | 12/1965 | Hiser | 366/130 |
| 3,351,970 | 11/1967 | Engh . | |
| 3,404,870 | 10/1968 | Multer | 366/307 |
| 4,050,678 | 6/1982 | Engler | 366/605 |

FOREIGN PATENT DOCUMENTS

| | | | |
|---|---|---|---|
| 911427 | 10/1972 | Canada | 366/307 |

*Primary Examiner*—Robert W. Jenkins
*Attorney, Agent, or Firm*—Leon Gilden

[57] ABSTRACT

A paint container is set forth wherein internal mixing of paint is effected by an oscillation of the paint can by means of the associated bail or handle pivotally secured thereon. A plurality of diametrically opposed arcuate vanes are integrally secured opposed to one another to an interior surface wall of a paint container. The vanes are of a height less than that of the internal shape defined by a radius equal to that of said paint container. The vanes are formed with a matrix of apertures therethrough to enhance the flow and turbulence of the paint within the container to effect the mixing of the paint. A tubular conduit positioned internally of said paint container is provided with an internal closure totally secured to an outlet port of said conduit enabling the attachment of various devices, such as airless paint guns and the like without removal of a lid associated with a paint container.

6 Claims, 4 Drawing Sheets

PAINT MIXING PAINT CONTAINER

BACKGROUND OF THE INVENTION

1. Field of the Invention

The present invention relates to paint containers, and more particularly pertains to a new and improved paint container which provides effective stirring of paint within said container without the need for removal of an associated lid of said paint container.

2. Description of the Prior Art

The stirring of paint in a container and apparatus for this purpose is well known in the prior art. As may be appreciated, stirring devices for mixing of paint within a paint container have normally been of elaborate and expansive construction to effect mixing of paint within a container. Typically, vibratory energy is utilized for mixing of the paint whereas an alternative has been the removal of a lid associated with a typical paint container for the manual storing of the paint therein. Various paint containers have been developed in the prior art for various purposes in association with the containers. For example, U.S. Design Pat. No. 28,095 to Mills presents a paint container with an associated corrugated surface formed internally of said container ostensibly for enhanced pouring of paint within the container or for the cleaning of a brush therealong for removal of excess paint from the brush.

U.S. Design Pat. No. 28,326 to Joy similarly presents a curvilinear surface of corrugated fluting which ostensibly may assist in metered pouring and the cleaning of brushes along said fluting.

U.S. Design Pat. No. 23,086 to Meisner provides a fluted roller associated with a paint tray which may provide a basis for the stirring of paint within said tray or the mechanical cleaning of brushes and the like in use with said tray.

U.S. Design Pat. No. 245,450 to Donion presents a paint container with a formed tray thereabout to ostensibly maintain paint at a certain level in said container and apparently for the mechanical cleaning of a brush by means of an associated rod at a predetermined level within said container.

U.S. Pat. No. 482,082 to Deming presents a paint container with a plurality of spouts wherein a centrally oriented divider wall effectively compartmentalizes a plurality of sections within a container.

U.S Pat. No. 3,351,970 to Engh presents a vertically positionable paint tray and roller combination wherein a paint tray is positioned vertically relative to an orthogonally oriented bucket enabling the utilization of the paint tray at a vertical orientation for transport by a user thereof.

As such, it may be appreciated that there is a continuing need for a new and improved paint mixing paint container which addresses both the problem of effectiveness and compactness and in this respect, the present invention substantially fulfills this need.

SUMMARY OF THE INVENTION

In view of the foregoing disadvantages inherent in the known types of paint containers now present in the prior art, the present invention provides a paint mixing paint container wherein the same provides effective mixing of paint within the container without removal of an associated lid of said container to effectively and efficiently mix paint contained within said container without associated spillage, and an associated spout formed to a conduit presenting itself within said container enables attachment of said spout to accessory apparatus, such as spray gun. As such, the general purpose of the present invention, which will be described subsequently in greater detail, is to provide a new and improved paint mixing container which has all the advantages of the prior art paint containers and none of the disadvantages.

To attain this, the present invention comprises a paint container formed with a conventional removable lid and pivotal handle with terminal ends of said handle secured to exterior upper diametrically wall portion of the paint container. The paint container is of a conventional cylindrical configuration wherein the mixing of said paint within container is effected by oscillating movement of said container effected by manual clockwise/counter clock-wise alternating rotation of the paint container wherein a plurality of arcuate of vanes radially displaced inwardly of an interior wall surface of said paint container effects agitation and accordingly the mixture of a paint within the container. The vanes are provided with a matrix of apertures to enhance the flow and turbulence of the paint within the container to effect the mixing. The vanes are of an arc of curvature equal to that of said paint container to minimize constriction of paint between said vanes and the interior surface of the paint container. A conduit formed within said container positioned proximate a vertical wall for clearance of said vanes is formed with an exteriorly terminating threaded outlet to said paint container with a removal closure for attachment of said outlet to various apparatus, such as airless spray guns, or merely for the pouring of said paint within said container without removal of said lid.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint mixing paint container which has all the advantages of the prior art paint containers and none of the disadvantages.

It is another object of the present invention to provide a new and improved paint mixing paint containers which may be easily and efficiently manufactured and marketed.

It is a further object of the present invention to provide a new and improved paint mixing paint container which is of a durable and reliable construction.

An even further object of the present invention is to provide a new and improved paint mixing paint container which is susceptible of a low cost of manufacture with regard to both materials and labor, and which accordingly is then susceptible of low prices of sale to the consuming public, thereby making such paint mixing paint containers economically available to the buying public.

Still yet another object of the present invention is to provide a new and improved paint mixing paint container which provides in the apparatuses and methods of the prior art some of the advantages thereof, while simultaneously overcoming some of the disadvantages normally associated therewith.

Still another object of the present invention is to provide a new and improved paint mixing paint container wherein a plurality of radially offset vanes positioned inwardly of interior surface walls of said paint container and diametrically opposed to one another effect agitation and mixing of paint within said container where said paint container is oscillated by means of an associated handle secured externally of said paint container and aligned with securement brackets secured to said vanes containing integrity and strength of said apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
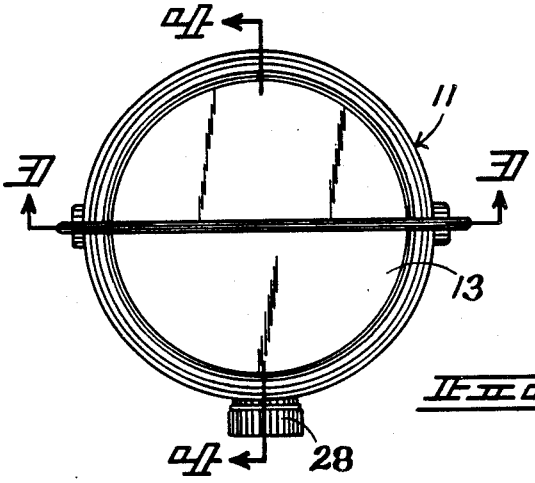
FIG. 1 is a top orthographic view of the instant invention.
Figure 2:
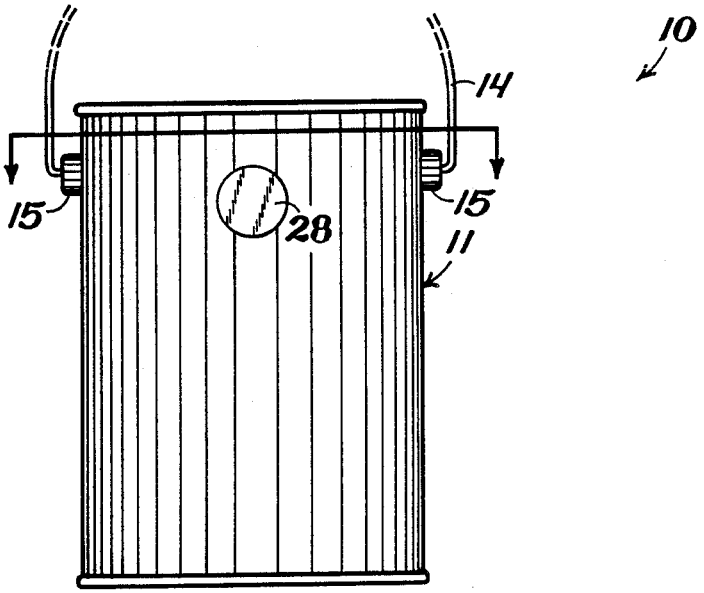
FIG. 2 is an orthographic view taken in elevation of the instant invention.
Figure 3:
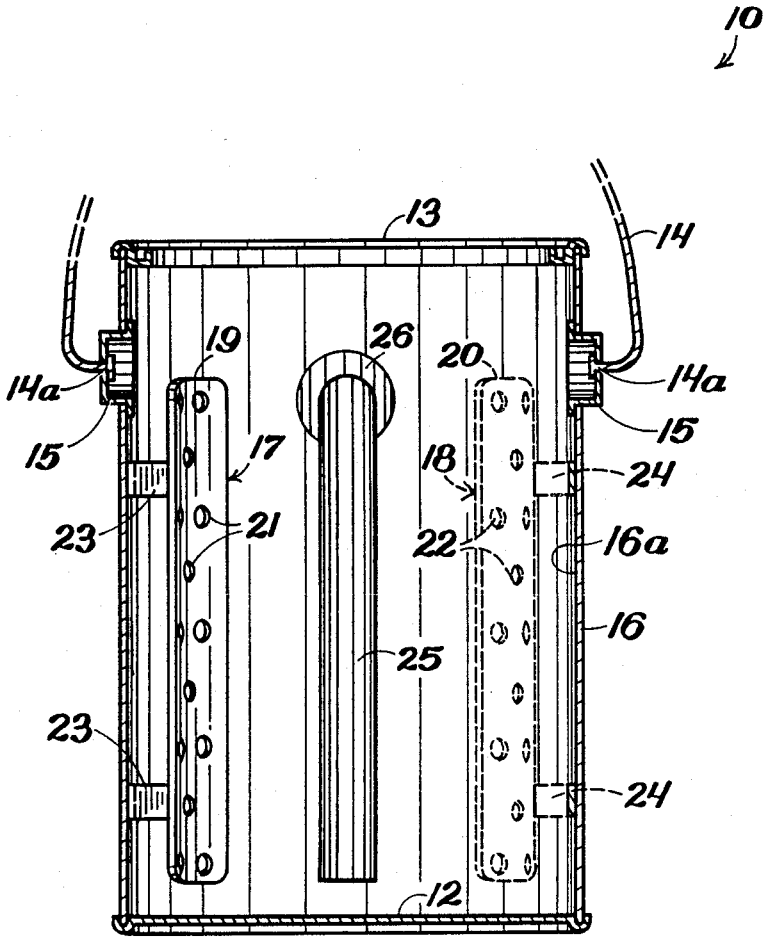
FIG. 3 is an orthographic view taken along the lines 3—3 of FIG. 1 in the direction indicated by the arrows.
Figure 4:
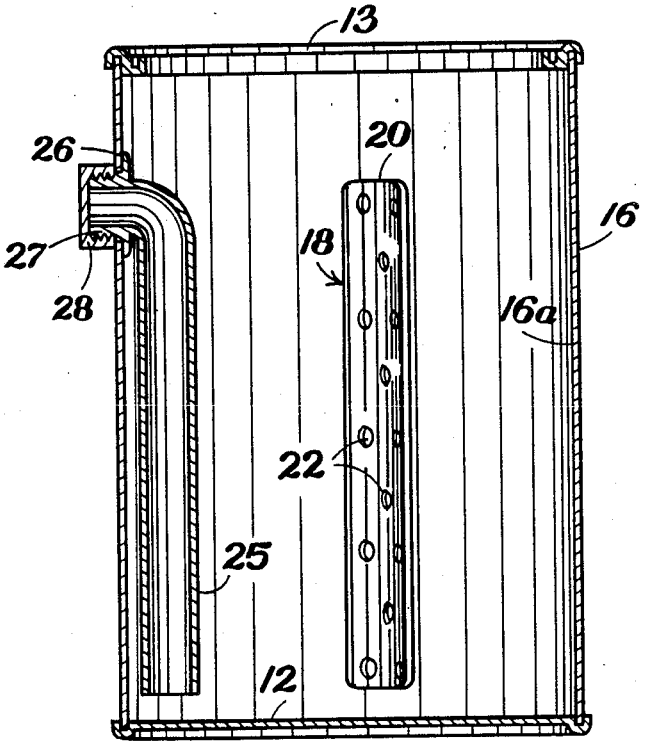
FIG. 4 is an orthographic view taken along the lines 4—4 of FIG. 1 in the direction indicated by the arrows.
Figure 5:
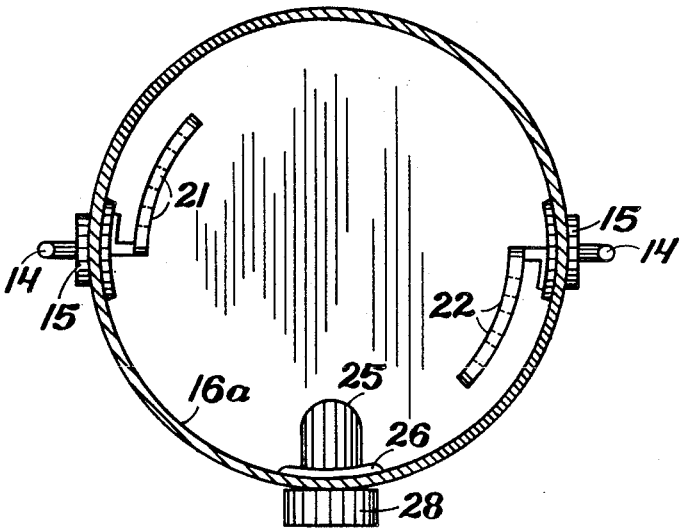
FIG. 5 is an orthographic view taken along the lines 5—5 of FIG. 2 in the direction indicated by the arrows.

With reference now to the drawings, and in particular to FIGS. 1 to 5 thereof, a new and improved paint mixing paint container embodying the principles and concepts of the present invention and generally designated by the reference numeral 10 will be described.

More specifically, it will be noted that the paint mixing paint container 10 essentially comprises a conventional container 11 formed with a integral floor 12 and overlying securement lid 13 of conventional construction. The container, as is conventional in the prior art, is of cylindrical configuration. An arcuate handle 14 is secured at diametrically opposed upper terminal portions of the vertical wall 16 of the paint container 11 and pivotally secured thereto to ears 15. A plurality of orthogonally oriented handle ends **14*a* project through bearing openings in the ears 15 to enable pivotment of the handle 14 relative to the paint container 11**.

Integrally secured to an interior wall surface **16*a* of the container 11 are a plurality of vanes comprising a first vane 17 and a second vane 18. The vanes are rectangularly concave arcuate configuration relative to the axial center line of the paint container and are generally of a radius of curvature equal to that of defining the cylindrical wall 16 of the paint container 11. The vanes are of a height substantially less than that of the interior length of the paint inner wall 16 extent and terminate above the floor 12 and in line with the handle ends 14*a* to provide a mixing volume above respective upper terminal edges 19 and 20 respectively of the first and second vanes. The vanes are furthermore formed with through extending apertures defined as first vane apertures 21 and second vane apertures 22 for enhanced flow and turbulent agitation of paint within the paint container 11**.

A plurality of first vane securement brackets 23 are secured to the interior surface **16*a* of the paint container and to the first vane 17 wherein similarly second vane securement bracket 24 secure the second vane 28 to the interior wall surface of the paint container 11 wherein the vanes 17 and 18 are generally parallel aligned with the axial center of the paint container 11**.

A conduit 25 extends interiorly of said paint container 11 parallel to the interior wall surface **16*a* and generally adjacent thereto terminating somewhat above the wall surface 12 and aligned with lower terminal edges of the respective first and second vanes 17 and 18. The conduit extends upwardly and aligned with upper terminal edges 19 and 20 respectively of the first and second vanes 17 and 18. A sealing flange 26 provides a liquid and airtight seal of the conduit 25 with relation to the paint container wall 16 wherein the conduit 28 as it is orthogonally directed outwardly of the paint container with respect to the linear extent of the conduit within the paint container terminates the threaded projecting portion 27 of complementary configuration to attachments such as air guns and the like. When not in use, the threaded end 27 is sealingly secured with a complementary threaded cap 28. Understandably, the conduit 25 may also be utilized to pour paint from the container 11 without removal of lid 13**.

In use, an individual manually grasps handle 14 and by effecting an oscillating motion thereto of a clockwise/counter clock-wise rotary motion, paint within the paint container 11 is thoroughly agitated and mixed without removal of the associated lid 13.

With respect to the above description then, it is to be realized that the optimum dimensional relationships for the parts of the invention, to include variations in size. materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint container for the mixing of paint contained within the container comprising, a cylindrical container having an interior surface and including a removable overlying lid, the container further including a continuous vertical wall integrally secured to a floor parallel to said lid, and a handle means including two terminal ends pivotally secured to the vertical wall of said container, and a plurality of arcuate vane means integrally secured to the interior surface of said container means for operative cooperation with rotary motion of said handle means for mixing of paint within said container, and wherein said handle means is formed as an arcuate handle terminating in respective orthogonal ends secured to said container at diametrically opposed positions, and wherein said vane means include two arcuate vanes of a height less than that of said wall of said paint container secured to the interior surface defined by said vertical wall, and wherein each of said vanes terminate in upper terminal ends aligned with said handle ends, and lower terminal ends of each of said vanes terminate at a position above said floor, and wherein each of said vanes defines an arcuate configuration equal to that of the radius of curvature of the cylindrical wall of said paint container.

2. A paint mixing paint container as set forth in claim 1 wherein each of said vane is provided with a matrix of apertures along the length of each of said vanes, and said vanes are parallel to an axis defining the axis of rotation of said cylindrical container means.

3. A paint mixing paint container as set forth in claim 2 wherein each of said vanes are spaced from the interior surface of said wall by a plurality of brackets.

4. A paint mixing paint container as set forth in claim 3 wherein said paint container further includes a tubular conduit aligned with the upper terminal ends of said vanes and directed outwardly of said paint container in a sealing relationship thereto terminating in a threaded end selectively secured by a complementary threaded cap.

5. A paint mixing paint container as set forth in claim 4 wherein said conduit is directed adjacent to and parallel to the wall of said container and terminating in alignment with lower terminal ends of each of said vanes.

6. A paint mixing paint container as set forth in claim 5 wherein said bracket and said ends of said handles are in alignment for imparting integrity and said strength to said container.

* * * * *